US008497455B2

(12) United States Patent
Hodson et al.

(10) Patent No.: US 8,497,455 B2
(45) Date of Patent: Jul. 30, 2013

(54) MICROWAVE COOKING CONTAINERS WITH SHIELDING

(75) Inventors: Jay Daniel Hodson, Greenville, WI (US); Brian David Douglas, Appleton, WI (US); Mena Rose Klittich, Zionsville, IN (US); Lance Layne Cvancara, Appleton, WI (US); Andrew Donald Lohoff, Oshkosh, WI (US)

(73) Assignee: Bemis Company, Inc., Neenah, WI (US)

( * ) Notice: Subject to any disclaimer, the term of this patent is extended or adjusted under 35 U.S.C. 154(b) by 419 days.

(21) Appl. No.: 12/714,131

(22) Filed: Feb. 26, 2010

(65) Prior Publication Data

US 2010/0230403 A1 Sep. 16, 2010

Related U.S. Application Data

(60) Provisional application No. 61/209,916, filed on Mar. 11, 2009.

(51) Int. Cl.
*H05B 6/80* (2006.01)

(52) U.S. Cl.
USPC ..... 219/728; 219/729; 219/734

(58) Field of Classification Search
USPC ..... 219/725–730, 732, 734
See application file for complete search history.

(56) References Cited

U.S. PATENT DOCUMENTS 3,219,460 A * 11/1965 Brown ..... 426/107
3,271,169 A 9/1966 Baker et al.
3,302,632 A * 2/1967 Fichtner ..... 219/728
3,547,661 A 12/1970 Stevenson
3,615,713 A 10/1971 Stevenson
3,985,991 A 10/1976 Levinson
3,985,992 A 10/1976 Goltsos
4,013,798 A 3/1977 Goltsos
4,080,524 A 3/1978 Greenfield, Jr. et al.
4,081,646 A 3/1978 Goltsos
4,122,324 A 10/1978 Falk (Continued)

FOREIGN PATENT DOCUMENTS

NZ 570272 11/2009

OTHER PUBLICATIONS

International Search Report issued in related International Patent Application No. PCT/US2010/026652, dated Jun. 7, 2010.

(Continued)

*Primary Examiner* — Ngan Ngo
(74) *Attorney, Agent, or Firm* — Tom J. Hall

(57) ABSTRACT

A microwave oven cooking container is provided for evenly cooking foodstuff without risk of sparking during cooking. The container includes at least one compartment, and has at least two separate shields disposed on the container. A first shield is made of a material substantially opaque to microwave energy and is disposed on an outer or an inner surface of the compartment, with a shape generally corresponding to the outer shape of the compartment and optionally having an aperture on the base. The container further includes a lidding configured to seal the container closed, the lidding having a second shield disposed on the lidding, such as at a predetermined distance from the container sidewalls. Further, a multi-compartment container is configured to provide shielding for a food having a low specific heat capacity with one or more compartments arranged around and at least partially surrounding a shielded central compartment for the food.

21 Claims, 14 Drawing Sheets

U.S. PATENT DOCUMENTS

| | | | |
|---|---|---|---|
| 4,133,996 | A | 1/1979 | Fread |
| 4,144,435 | A | 3/1979 | Clark et al. |
| 4,190,757 | A | 2/1980 | Turpin et al. |
| 4,204,105 | A | 5/1980 | Leveckis et al. |
| 4,266,108 | A | 5/1981 | Anderson et al. |
| 4,345,133 | A | 8/1982 | Cherney et al. |
| 4,351,997 | A | 9/1982 | Mattisson et al. |
| 4,450,334 | A | 5/1984 | Bowen et al. |
| 4,486,640 | A | 12/1984 | Bowen et al. |
| 4,503,307 | A | 3/1985 | Campbell et al. |
| 4,594,492 | A | 6/1986 | Maroszek |
| 4,626,641 | A | 12/1986 | Brown |
| 4,689,458 | A | 8/1987 | Levendusky et al. |
| 4,703,148 | A | 10/1987 | Mikulski et al. |
| 4,851,631 | A | 7/1989 | Wendt |
| 4,866,234 | A | 9/1989 | Keefer |
| 4,874,917 | A | 10/1989 | Weimer |
| 4,883,936 | A | 11/1989 | Maynard et al. |
| 4,894,503 | A | 1/1990 | Wendt |
| 4,926,020 | A | 5/1990 | Atwell et al. |
| 4,972,058 | A | 11/1990 | Benson et al. |
| 4,972,059 | A | 11/1990 | Wendt et al. |
| 4,973,502 | A | 11/1990 | Holzmüller et al. |
| 5,021,293 | A | 6/1991 | Huang et al. |
| 5,053,594 | A | 10/1991 | Thota et al. |
| 5,057,331 | A | 10/1991 | Levinson |
| 5,079,396 | A | 1/1992 | Katz et al. |
| 5,126,518 | A | 6/1992 | Beckett |
| 5,126,520 | A | 6/1992 | Nottingham et al. |
| 5,260,537 | A | 11/1993 | Beckett |
| 5,288,962 | A | 2/1994 | Lorence et al. |
| 5,370,883 | A | 12/1994 | Saunier |
| 5,424,517 | A | 6/1995 | Habeger, Jr. et al. |
| 5,558,798 | A | 9/1996 | Tsai |
| 5,593,610 | A | 1/1997 | Minerich et al. |
| 5,698,127 | A | 12/1997 | Lai et al. |
| 5,718,370 | A | 2/1998 | Lafferty et al. |
| 5,736,718 | A | 4/1998 | Levinson |
| 5,961,872 | A | 10/1999 | Simon et al. |
| 6,054,697 | A | 4/2000 | Woodward et al. |
| 6,102,281 | A | 8/2000 | Lafferty et al. |
| 6,229,131 | B1 | 5/2001 | Koochaki |
| 6,231,903 | B1 | 5/2001 | Ji et al. |
| 6,410,896 | B2 | 6/2002 | Witonsky et al. |
| 6,486,455 | B1 | 11/2002 | Merabet |
| 6,501,059 | B1 | 12/2002 | Mast |
| 6,696,677 | B2 | 2/2004 | Kennedy |
| 6,717,121 | B2 | 4/2004 | Zeng et al. |
| 6,777,655 | B2 | 8/2004 | Zhang et al. |
| 7,154,073 | B2 | 12/2006 | Iwai et al. |
| 7,476,830 | B2 * | 1/2009 | Middleton et al. ..... 219/729 |
| 7,482,560 | B2 | 1/2009 | Golden et al. |
| 7,491,416 | B2 | 2/2009 | Zhang et al. |
| 2004/0084445 | A1 | 5/2004 | Weijer et al. |
| 2004/0238534 | A1 | 12/2004 | Mast |
| 2006/0118552 | A1 | 6/2006 | Tiefenback |
| 2007/0029316 | A1 | 2/2007 | Fernandez |
| 2007/0237867 | A1 | 10/2007 | Kratochvil et al. |
| 2009/0039076 | A1 | 2/2009 | Maslowski et al. |
| 2009/0042705 | A1 | 2/2009 | Maslowski et al. |
| 2009/0084781 | A1 * | 4/2009 | Middleton et al. ..... 219/730 |
| 2009/0200364 | A1 | 8/2009 | Oliveira |
| 2009/0208614 | A1 | 8/2009 | Sharma et al. |
| 2009/0294439 | A1 | 12/2009 | Lai et al. |
| 2009/0304872 | A1 | 12/2009 | Chouikhi |
| 2010/0006567 | A1 * | 1/2010 | Cole ..... 219/730 |
| 2011/0120993 | A1 * | 5/2011 | Birchmeier et al. ..... 219/729 |
| 2011/0204046 | A1 * | 8/2011 | Middleton et al. ..... 219/730 |

OTHER PUBLICATIONS

Anantheswaran, Ramaswamy C., Data, Ashim K., Eds., Chapter 12—"Packaging Techniques for Microwaveable Foods", Handbook of Microwave Technology for Food Applications, 2001, p. 397-439, Marcel Dekker, Inc., New York.

Anantheswaran, Ramaswamy C., Data, Ashim K., Eds., "Arcing and Fires Caused by Metal", Handbook of Microwave Technology for Food Applications, 2001, p. 490-491, Marcel Dekker, Inc., New York.

Lorence, Matthew W., Pesheck, Peter S., Eds., Chapter 9: "Susceptors in microwave packaging", Development of packaging and products for use in microwave ovens, 2009, p. 207-235, CRC Press LLC, Boca Raton.

Lorence, Matthew W., Pesheck, Peter S., Eds., Chapter 10: "Shielding and field modification—thick metal films", Development of packaging and products for use in microwave ovens, 2009, p. 237-266, CRC Press LLC, Boca Raton.

Moskowitz, Howard R., Saguy, I. Sam, Straus, Tim, Eds., 1.4.3 "Factor 3: The Packaging Was Not Right", An Integrated Approach to New Food Product Development, 2009, p. 11-13, CRC Press, Boca Raton.

Sacharow, Stanley, Schiffmann, Robert F., Chapter 7: "Technical considerations in selecting the microwave package", Microwave Packaging, 1995, p. 103-134, Pira International, Surry, UK.

Sacharow, Stanley, Schiffmann, Robert F., "Active Packaging", Microwave Packaging, 1995, p. 142-147, Pira International, Surly, UK.

* cited by examiner

MICROWAVE COOKING CONTAINERS WITH SHIELDING

CROSS REFERENCE TO RELATED APPLICATIONS

This application claims priority to provisional U.S. Application Ser. No. 61/209,916, filed Mar. 11, 2009, which is incorporated herein by reference in its entirety.

FIELD OF THE INVENTION

The invention relates to microwave cooking containers comprising shielding from microwave energy. In particular, the invention relates to microwave cooking containers providing improved even heating throughout food that is disposed in the containers, upon cooking in a microwave oven.

BACKGROUND OF THE INVENTION

Microwave cooking has long been employed to conveniently and quickly cook comestibles, such as comestibles stored at ambient, refrigerated or frozen temperatures. A common disadvantage of microwave cooking of foods and beverages is uneven heating throughout the container. For instance, the outer edges of a food product typically heat faster than the center of the food product. It would therefore be desirable to provide a way to prevent microwaves from acting on selected areas of a product placed in a microwave oven. By preventing or reducing the amount of microwave energy that reaches the product, the amount of energy that is absorbed by the product can be influenced, thus controlling the rate of heating of the product.

Various previous efforts to provide shielding of microwave energy from portions of a container increased the risk for arcing or sparking during microwave cooking, due to the use and configuration of metallic shielding material with microwave containers. In addition, microwave containers for foodstuffs typically include instructions for consumers regarding microwave timing and power, as well as whether or not to peel back or puncture the lidding. However, not all consumers read or follow the instructions precisely, and altering the location of some microwave shielding elements may result in a potentially dangerous configuration of shielding elements. Thus, it would be desirable to provide microwave shielded containers that do not pose a risk of arcing or sparking even if the consumer does not completely comply with the instructions.

SUMMARY

An aspect of the invention is directed to a container comprising at least one compartment for holding food comprising a base comprising a shape having a perimeter, and a plurality of sidewalls extending upwardly from the perimeter of the base at an angle therefrom. The at least one compartment comprises a first shield comprising a material opaque to microwave energy disposed on an inner or outer surface of the base and the plurality of sidewalls. The first shield optionally defines an aperture centered on the base, wherein the aperture comprises the same shape as the base. The container further comprises a lidding configured to be sealed on the at least one compartment, the lidding comprising a second shield comprising a material opaque to microwave energy. The second shield may be disposed on the lidding at a predetermined distance from the plurality of sidewalls, or alternatively may cover substantially the entire lidding.

Another aspect of the invention is directed to a container comprising a first compartment comprising a material substantially transparent to microwave energy, a first shield comprising a material substantially opaque to microwave energy disposed on an inner or outer surface of the compartment, and a lidding configured to seal the first compartment, the lidding comprising a second shield comprising a material opaque to microwave energy. The container further comprises a second compartment at least partially surrounding the first compartment, for instance completely surrounding the first compartment. Alternatively, the container comprises a third compartment, in which the second and third compartments each partially surround the first compartment.

DETAILED DESCRIPTION OF THE INVENTION

A partially shielded microwave container may be employed for heating a shelf-stable, cold or frozen foodstuff in a microwave oven. The application of strategic shielding of only select areas of the product will allow only certain portions, for example a frozen meal, to heat to a higher temperature than that of other portions. By incorporating shielding into the packaging of a shelf-stable, refrigerated or frozen foodstuff, different types of food may be cooked in the same tray with different degrees of heating for each separate food such that each of the foods finish cooking at the same time.

It was discovered that providing two or more microwave energy shields on a single container or container compartment can synergistically provide more even cooking throughout a foodstuff disposed in the container than in an unshielded compartment or a compartment without the specific arrangement of the shields. In particular, it was discovered that shields that reflect microwave energy may be employed to redirect portions of the microwave energy to result in the more even heating of the foodstuff. Moreover, the arrangement of the microwave energy shields poses little to no risk of causing sparking or arcing within a microwave oven during cooking.

In an embodiment, a microwave container is provided comprising a material that is substantially transparent to microwave energy or radiation. Any suitable microwave transparent materials may be employed, such as are known in the art. For example and without limitation, crystalline polyethylene terephthalate (CPET) amorphous polyethylene terephthalate (APET), polypropylene (PP), high density polyethylene (HDPE), organic filled polypropylene, paperboard and paper laminations are commonly employed to form containers for microwave cooking of foodstuffs.

A microwave container or package may be provided comprising materials opaque or at least substantially opaque to microwave energy, and therefore will shield portions of a product disposed within the container or package from being exposed to the full amount of microwaves to which other portions of the product are exposed. The package comprises a substance or layer that will reflect, block or absorb the microwaves before they can reach the area of the product that needs to be protected. This blocking substance is defined herein as a "shield." Any suitable material that is capable of reflecting, blocking, and/or absorbing microwave energy or radiation may be employed as a microwave shield. Such shielding materials may comprise, for example and without limitation, metal, metallic foil, and alloys. A common material for use as a microwave shield is aluminum, such as aluminum alloy 800616, however the shield can be any metal, metal alloy or nonmetal material that effectively blocks, reflects or absorbs microwave energy.

Figure 6:
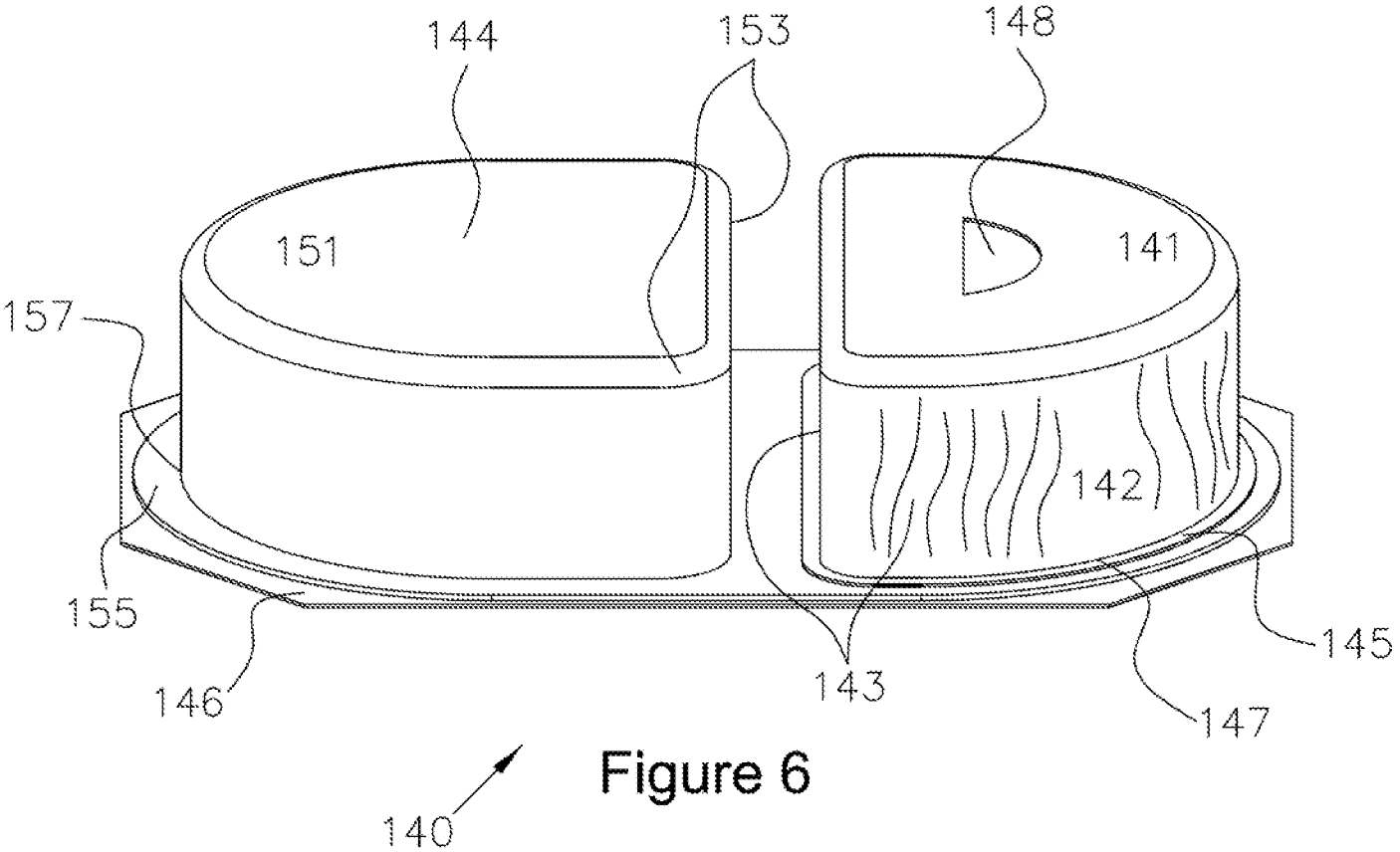
FIG. 6 shows a perspective view of a two-compartment container having a base shield with a center aperture on one compartment.
Figure 7:
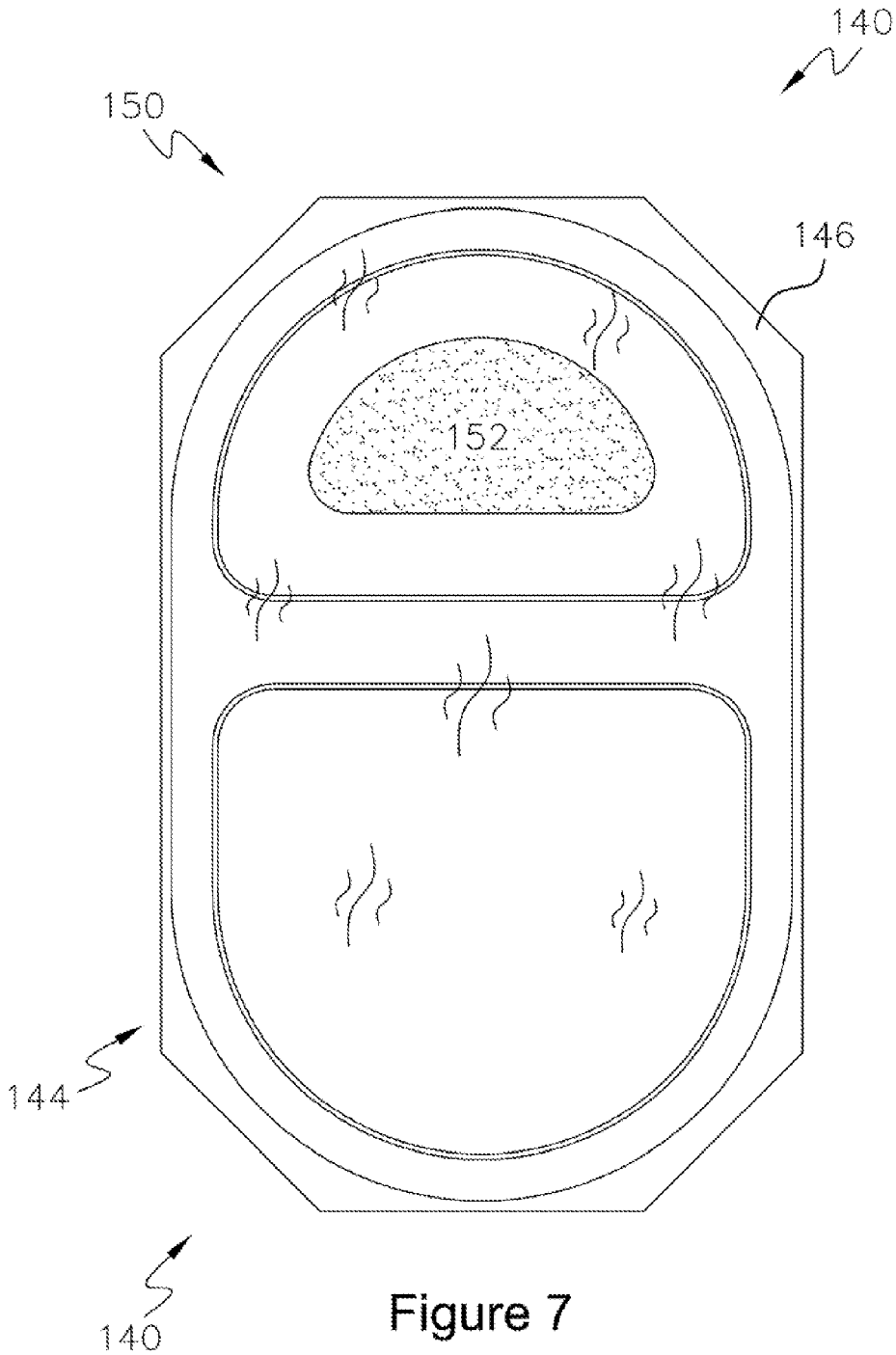
FIG. 7 shows a top view of a two-compartment container having a shield on the center of the lidding of one compartment.
Figure 8:
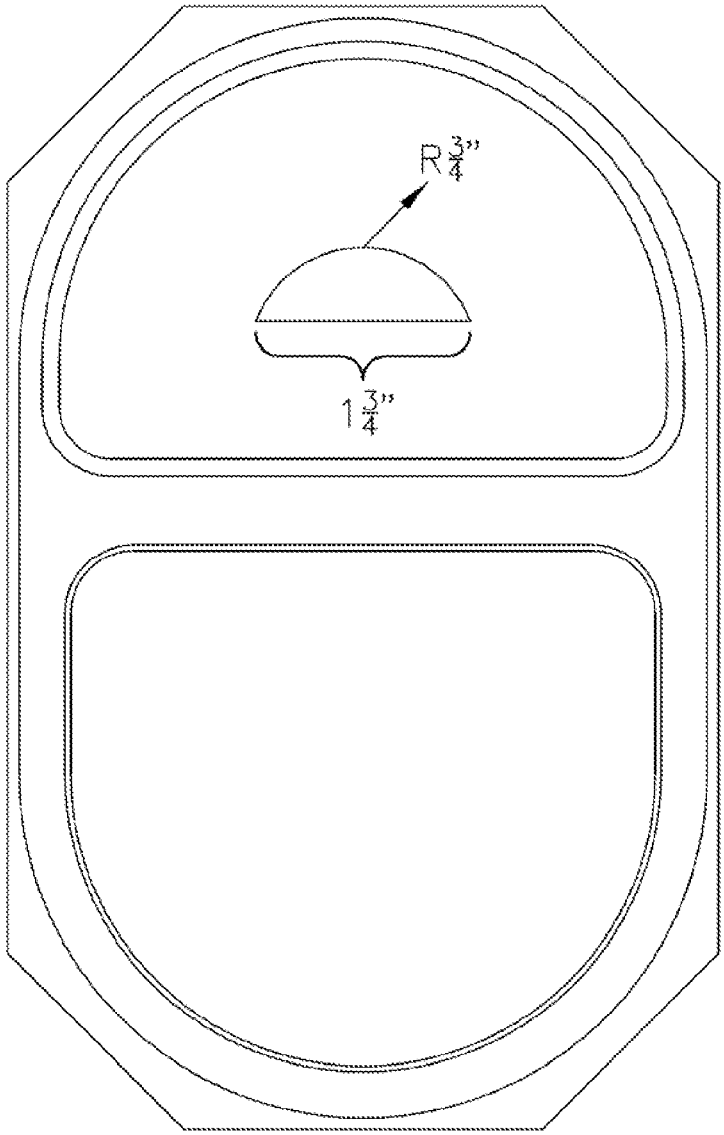
FIG. 8 shows a bottom view of a two-compartment container having a base shield with a center aperture on one compartment.

As discussed above, a microwave shield is configured to reflect, block, and/or absorb at least a portion of the microwave energy directed at a container in a microwave oven. In certain embodiments, a first microwave shield is provided in a shape that substantially conforms to the outer structure of at least a portion of a container. Referring to FIGS. 6-8, FIG. 6 shows an upside down microwave tray 140 comprising a material substantially transparent to microwave energy comprising a first compartment 150 (see FIG. 7) surrounded by a material opaque to microwave energy: a piece of metal foil shield 142 defining an aperture 148 that is located approximately in the center of the base 141 of the metal foil 142. Referring to FIG. 8, the aperture 148 comprises the same general shape as the base, and at least one of the height or width of the aperture 148 is at least half of one inch. In this embodiment, the aperture 148 semi-circle comprises a radius (i.e., the height at the tallest portion of the semi-circle aperture 148) of three-quarters of an inch, and a width of one and three-quarters inches. The height and width of the shield aperture are independently each a minimum of about one-quarter of an inch, and may be selected depending on the amount of microwave energy desired to be allowed into the container or container compartment through the base of the container. Foods having a higher specific heat capacity typically require more microwave energy to increase their temperature than foods having a lower specific heat capacity, and thus an aperture having a larger area would be selected to allow more microwave energy to enter the container than with an aperture having a smaller area.

The microwave tray 140 shown in FIGS. 6-8 further comprises an unshielded second compartment 144 comprising a substantially microwave-transparent material, and a polymeric film lidding 146 covering and affixed to the top of the entire tray 140. The foil shield 142 may be adhered to the compartment if desired, however it is not necessary. Alternatively, the foil shield 142 may be fitted onto the compartment. In certain embodiments, a shield may be provided by more than a single piece of microwave opaque material, for instance by two or more individual pieces of shield having an adhesive or a sealant polymeric film provided on one surface of each of the shield pieces. The adhesive or sealant film affixes the shield to the container, thus providing a kind of shield sticker or label on the container. Although the first shield 142 is shown to be disposed on an outer surface of the base and the sidewalls of the first compartment 150, it may be provided in other locations, such as between two polymeric container layers, or on an inner surface of the container.

In the embodiment shown in FIGS. 6-8, the metal foil shield 142 is formed to substantially conform to the outer surface of the first compartment 150. The foil shield 142 comprises a base 141 having a shape defined by a perimeter of the base 141, such as a semi-circle with rounded edges. The base 141 comprises one or more sidewalls 143 extending upwardly from the perimeter of the base at an angle therefrom, and having an upper edge 147. The angle may range between about 60 degrees and about 135 degrees with respect to the base, such as about 90 degrees. The height of the sidewalls 143 may be varied, such as between a height of one half of an inch to two and one-half inches, or to approximately the same height as the sidewalls of the container compartment, which may be about one and one quarter inches tall. In aspects of the invention, the one or more sidewalls 143 of the foil 142 further comprise a lip 145 extending radially from the upper edge 147 of the sidewalls 143. Referring to FIG. 8, the lip 145 comprises a height of one half of an inch. Other heights for the lip 145 are contemplated, such as between one-sixteenth of an inch to seven-eighths of an inch.

In certain embodiments, the first shield covers the entire base of the compartment and thus does not comprise an aperture. Such a configuration is selected for applications in which a foodstuff has a low specific heat capacity and thus requires greater shielding than foods having a higher specific heat capacity. As used herein, the term "specific heat capacity" is defined as the amount of energy required to raise the temperature of a unit quantity of food by one unit, such as to raise the temperature of one gram of food by one degree Fahrenheit. When a first shield is provided covering the entire container base, microwave energy may enter the container through other, unshielded areas, of the container. For instance, the container may comprise a horizontal or vertical gap between the upper edge of the first shield sidewalls and the outer edge of the second shield.

Similar to the first compartment 150, the tray 140 comprises a second compartment 144 that comprises a base 151 having a shape defined by a perimeter of the base 151. The base 151 comprises one or more sidewalls 153 extending upwardly from the perimeter of the base at an angle therefrom, and having an upper edge 157, the second compartment optionally consisting essentially of one or more materials transparent to microwave energy. The angle may range between about 60 degrees and about 135 degrees with respect to the base, such as about 90 degrees. The one or more sidewalls 153 of the second compartment 144 further comprise an optional lip 155 extending radially from the upper edge 157 of the sidewalls 153. The presence of a lip 155 provides a convenient surface to which a lidding 146 may be adhered or sealed once the compartments have been filled.

Figure 10:
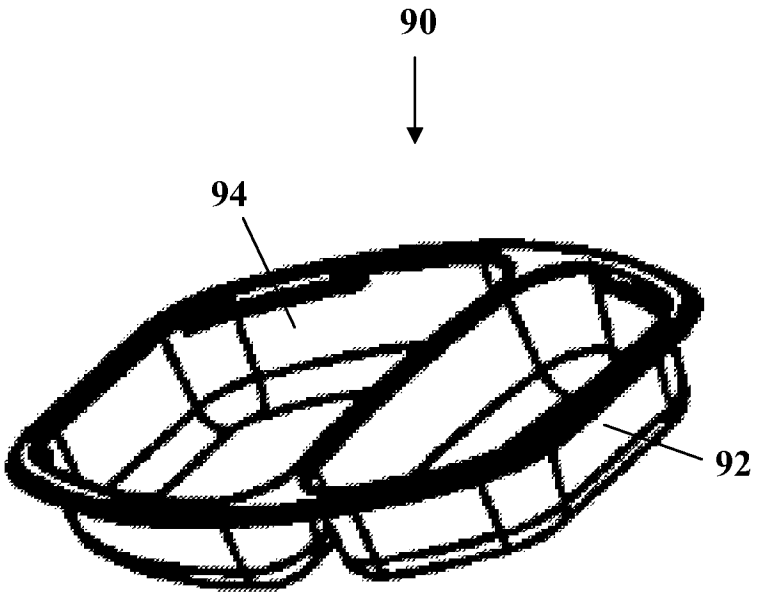
FIG. 10 shows a perspective view of the two-compartment container of FIG. 9.
Figure 9:
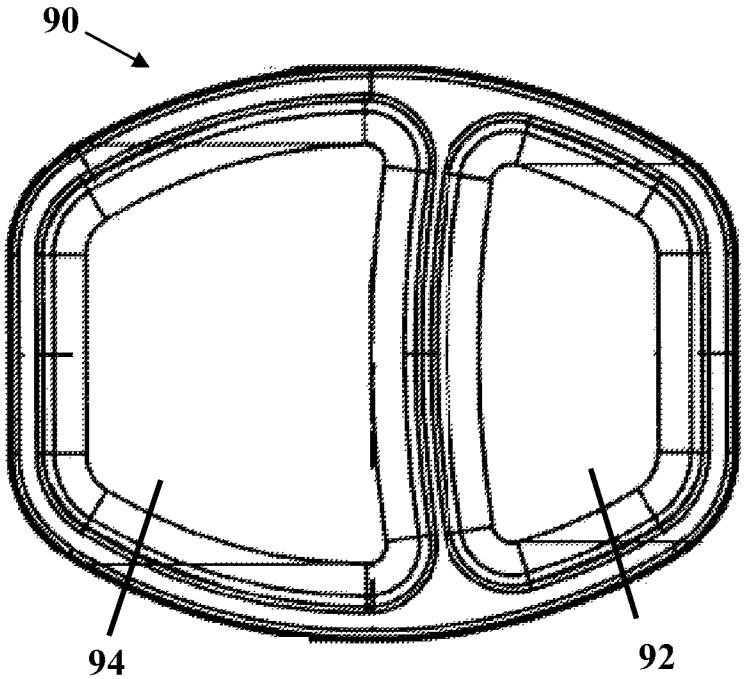
FIG. 9 shows a top view of a two-compartment container according to an embodiment.

In embodiments of the invention, a container may comprise any number of compartments comprising a base and sidewalls as described for tray 140. Any shape suitable for containing materials such as foods may be selected for the one or more compartments. For example and without limitation, geometrical shapes such as rectangles, ovals, circles, squares, trapezoids, semi-circles, triangles, and concentric rings may be suitable for the one or more compartments. Referring to FIGS. 9 and 10, in one embodiment, a two-compartment container 90 may be provided having a first compartment 92 and a second compartment 94. The shapes of the first compartment 92 and second compartment 94 may each be described as essentially trapezoidal, and having somewhat curved sides and rounded corners. Other shapes having any number of sides and corners are contemplated, and often, the corners of the compartment shapes will be rounded.

Referring to FIG. 7, the polymeric film lidding 146 of the microwave tray 140 further comprises a second microwave shield 152 disposed on and adhered to the lidding 146. The second microwave shield 152 comprises a material substantially opaque to microwave energy, and is centered on the lidding 146 separated from the perimeter or upper edges of the sidewalls 143 by a predetermined distance. In certain embodiments, the second microwave shield 152 is spaced from the sidewalls 143 by an approximately even distance of at least one quarter of an inch, or of at least half of an inch, all of the way around the outer edge of the second microwave shield 152. The distance between the outer edge a microwave shield disposed on a container lidding and the sidewalls of the container may range from about one-eighth of an inch or larger, depending on the relative size of the tray, and may be selected depending on the amount of microwave energy desired to be allowed into the container or container compartment. As noted above, foods having a high specific heat capacity typically require more microwave energy to increase their temperature than foods having a low specific heat capacity, and thus a larger distance between the second shield and the sidewalls would be selected to allow more microwave energy to enter the container than with a smaller distance between the shield and the sidewalls.

The lidding 146 comprises any suitable, substantially microwave transparent material for sealing microwave containers once a foodstuff has been disposed within the container or container compartment. Typical materials employed as lidding include, for example and without limitation, heat sealable polymeric films, paper, and paperboard laminations. A few examples of heat sealable polymeric films include Toray Lumilid XL5, which comprises heat sealable polyester, Dupont RL31, which comprises biaxially oriented polyester with an ethylene vinyl acetate heat seal layer, and a sealable polyethylene terephthalate/ethylene vinyl acetate film structure. Suitable lidding material should be easy to attach to the container, provide sufficient abrasion and puncture resistance to maintain the integrity of the package during transport, storage and handling, and be easily removed by the consumer.

In certain embodiments, a microwave container may be provided configured generally opposite or upside-down, as compared to the containers of FIGS. 6-8. In such embodiments, the foodstuff is disposed on a substantially flat, plate-like element and a cap is disposed over the food. Accordingly, as used herein, the term "lidding" is defined as a generally planar portion of the microwave container, thereby encompassing both a container cover as described above, as well as a plate-like surface on which food may deposited. Concomitantly, as used herein, the term "compartment" is defined as a dish or tray-like element comprising a volume for containing the foodstuff, thereby encompassing both the container compartments described above and illustrated in the Figures, as well as a cover or cap-like element placed over a foodstuff. It is not important which orientation of the combination of compartment and lidding is provided for the microwave containers of the invention.

As noted above, it was discovered that disposing two or more microwave energy shields on a single container or container compartment can synergistically provide a more even cooking of a foodstuff disposed in the container than in a container or container compartment that does not comprise the particular arrangement of the shields. In general terms, a two-shield system comprises one shield disposed on a container compartment (e.g., the foil shield 142 on the first compartment 150) and a second shield disposed on the lidding of the container (e.g., the second shield 152 on the lidding 146). In certain embodiments, the shapes and locations of the first and second shields are substantially complementary: the first shield defines a center aperture, whereas the second shield is located in the center on the opposite side with a gap between the outer edges of the second shield and the perimeter of the container compartment. It was discovered that the first shield works to absorb, transmit and reflect microwave energy from an opposing direction compared to the second shield on the contrasting location of the container. With the combination of the first and second shields of this configuration interacting together, uniform heating is achieved.

In certain embodiments, the first and second shields reflect the microwave energy that enters the container through the unshielded areas to effectively redirect the microwave energy within the container to result in the more even heating of the foodstuff. This is believed to be due to the configuration of the shields that results in energy being allowed to enter the container or container compartment only from the selected direction(s), which evenly controls the rate of heating of a food product.

Moreover, the complementary arrangement of the microwave energy shields poses little to no risk of causing sparking or arcing within a microwave oven during cooking. In particular, it was discovered that keeping the first and second shields independent of each other and at a sufficient distance minimizes the potential for arcing between the shields and possibly resulting in a fire within the microwave oven. During cooking, energy on the shields may build up to an amount of over 3000 volts. Without wishing to be bound by theory, it is believed that when similar pieces of metallic shielding come into close contact, the air molecules may be disrupted and break down, which in turn allows the water molecules to achieve a plasma state. The plasma produces a conductor between two separate shields, thus resulting in an arc or spark bridging the gap between the two shields. Close proximity of the edges of microwave energy shields therefore provides a greater likelihood of sparks leaping between the shields.

Experiments with the location of first and second microwave shields were performed to investigate if food weight and food distribution throughout the microwave container could further act as a significant factor in sparking. It was discovered that sparking is more prone to happen where there is little to no food, such as in the event food contents have shifted towards the front of the container and solidified, leaving the back portion of the container substantially bare of food. This increase in risk of sparking is due to the higher mass amount of microwave energy being reflected, absorbed, and transmitted by the microwave energy shield, as compared to when energy is being absorbed by food located at the back portion of the container. Accordingly, it is preferable to provide an evenly filled microwave container or compartment.

The second shield may interact with the sidewalls of the first shield, such as sidewalls having a height of three quarters of an inch, or one and one-quarter inches, disposed over a container compartment having sidewalls that are approximately one and one-quarter inches tall. Although some microwave shield interaction was evident all around the shielded compartment, the areas of most concern for potential sparking include the corners of the second shield and sidewalls of the first shield having a height of three quarters of an inch. This concern was caused by the capability of the sidewalls of the first shield to readily transfer energy to and melt the sidewalls of a CPET microwave container, in the event that the food load is not sufficient to absorb enough of the microwave energy. Consequently, for embodiments in which the sidewalls of the first shield are not as high as the sidewalls of the container compartment, it is important to provide an evenly distributed food load that comprises a sufficiently high specific heat capacity, to absorb enough of the microwave energy to prevent significant energy transfer to the container sidewalls such that the sidewalls exhibit damage from the transfer of energy.

The location of the second shield is important, as if it is placed off-center and located close to or in contact with the compartment sidewalls, the second shield may be subject to sparking during cooking in a microwave oven. It was discovered that if the second shield is directly lined up with a sidewall of the first shield, there is a significantly greater potential for arcing through the microwave container. Moreover, if the second shield were to be placed off-center or to extend to the sidewall edges of the container and/or the first shield, there would be a higher risk of sparking if more than one of the same type of microwave container were placed together within a microwave. Placing two containers adjacent together and each having such second shields, the two second shields may come into contact with each other if located side by side, and potentially provide sparking between the second shields. Experiments showed that sparks were created when two containers comprising second shields extending to the sidewall edges of the container were placed touching or up to a half of an inch apart, but not when placed farther than half an inch apart.

To avoid potential sparking were a consumer to place two microwave containers having such a shielding configuration too close together in a microwave oven, it would instead be desirable to provide a microwave container that does not pose a risk of sparking regardless of how the consumer positions one or more containers in a microwave oven. A microwave container comprising a second shield centered on the lidding and having a gap of at least one quarter of an inch between the perimeter of the second shield and the sidewalls of the container, and/or the sidewalls of the first shield, has a lower probability of sparking because the second shield is located at a distance from the sidewalls, so there can be no interaction between the two second shields if two of the same microwave containers were put in the microwave oven at the same time. Indeed, experiments testing microwave cooking of such containers placed next to each other resulted in no instances of sparking between the containers.

As noted above, it is a possibility that a consumer will misunderstand or simply not follow the microwave cooking directions for a microwave container, thus it is important to provide containers configured to avoid sparking even when the instructions are not executed correctly. For example, a consumer could pull off the lidding, realize that it was supposed to remain attached, and then replace the lidding loosely over the container. Experiments were performed on microwave containers having different configurations, in which the lidding was removed and then placed back over the container. For a microwave container comprising a first microwave shield with sidewalls having a height of three quarters of an inch and an aperture in the base, as well as a second microwave shield extended to the container sidewalls, this experiment resulted in a fire within the microwave oven. In contrast, no fires or sparks were observed when this experiment was performed using a microwave container having a first microwave shield with sidewalls having a height of one and one-quarter inches (i.e., the same height as the container sidewalls) and an aperture in the base, as well as a second microwave shield centered on the lidding and located at a distance of one half of an inch from the container sidewalls.

Even though there was a vertical gap of half of an inch between the sidewalls of the first shield and the outer edge of the second shield, sparking and fires were still achieved upon exposure to microwave energy. Surprisingly, it was discovered that a horizontal gap of one half of an inch provides less of a risk of arcing and sparking of the shielded containers. Moreover, inclusion of an optional lip, which extends radially from the upper edge of the sidewalls further decreases the risk of sparking. As noted above, for microwave containers having a vertical gap between the first and second shields, the placement and specific heat capacity of the foodstuff within the microwave container play an important role in minimizing the risk of arcing and sparking of the shielded containers.

It is possible that the second shield will not remain properly affixed to the lidding during manufacturing or distribution, for instance resulting in the second shield to be rolled up on itself. Experiments with both of the above-described shielding configurations having a second shield rolled up on itself resulted in no observed fires and/or sparking for the container having a horizontal gap between the two shields, whereas a fire started on the edge of the sidewall of the container having a vertical gap between the two shields.

An example of incorrect handling of the inventive microwave shielded containers is for a consumer to poke holes in the lidding to vent heat and/or steam during microwave cooking. Experiments with both of the above-described shielding configurations resulted in no observed fires as a result of forming holes in the lidding. A further example of incorrect handling is for a consumer to partially peel off the second shield from the lidding, thinking that the second shield is supposed to be removed. Experiments with both of the above-described shielding configurations resulted in observed fires and sparking for the shield configuration having a vertical gap between the two shields, but not for the preferred shield configuration having a horizontal gap.

Embodiments of the invention successfully accomplish redirecting of microwave energy, resulting in shielding of a one or more compartment container. With the redirection of microwave energy, the presence of the shields results in a more even heating of a shelf-stable, refrigerated or frozen food product. In addition, a shielded compartment may be paired with a hot compartment to provide a multi-temperature microwavable meal. With the pairing of the invention and a food product, embodiments of the invention are capable of controlling the rate of heating of specific compartments to a desired temperature range, dependent on the food product. It will be appreciated by one of skill in the art that the dimensions of the microwave container, compartments, and shields can and will be changed to fit a specific food product to allow proper microwave energy to penetrate, thereby providing appropriate heating rates.

A foodstuff having a lower specific heat capacity typically has a faster microwave cooking time than the other foods exhibiting a higher specific heat capacity. In an embodiment, to allow different types of foods to cook in a microwave oven to approximately the same temperature following exposure to microwave energy, a faster-cooking food may be disposed in a container compartment positioned amongst or in between slower-cooking foods. Such an arrangement takes advantage of the phenomenon that the foodstuff located in the center of a microwave container cooks more slowly than foodstuff located closer to the peripheral edges of the container.

Figure 2:
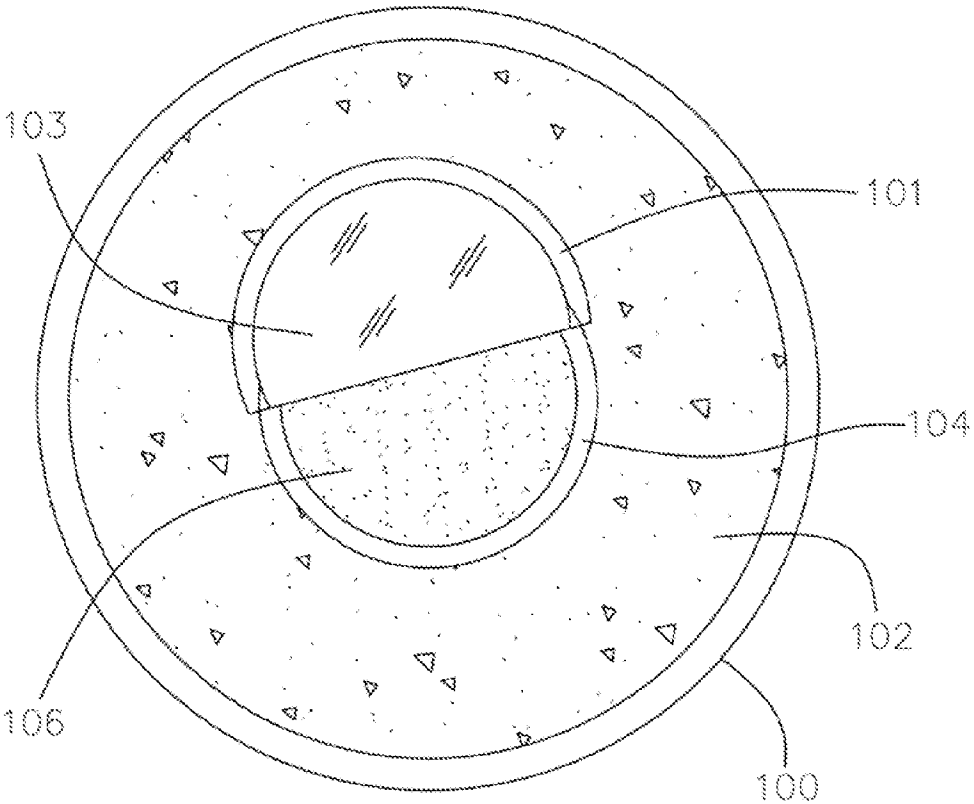
FIG. 2 shows a top and a base shield on a center dish.
Figure 3:
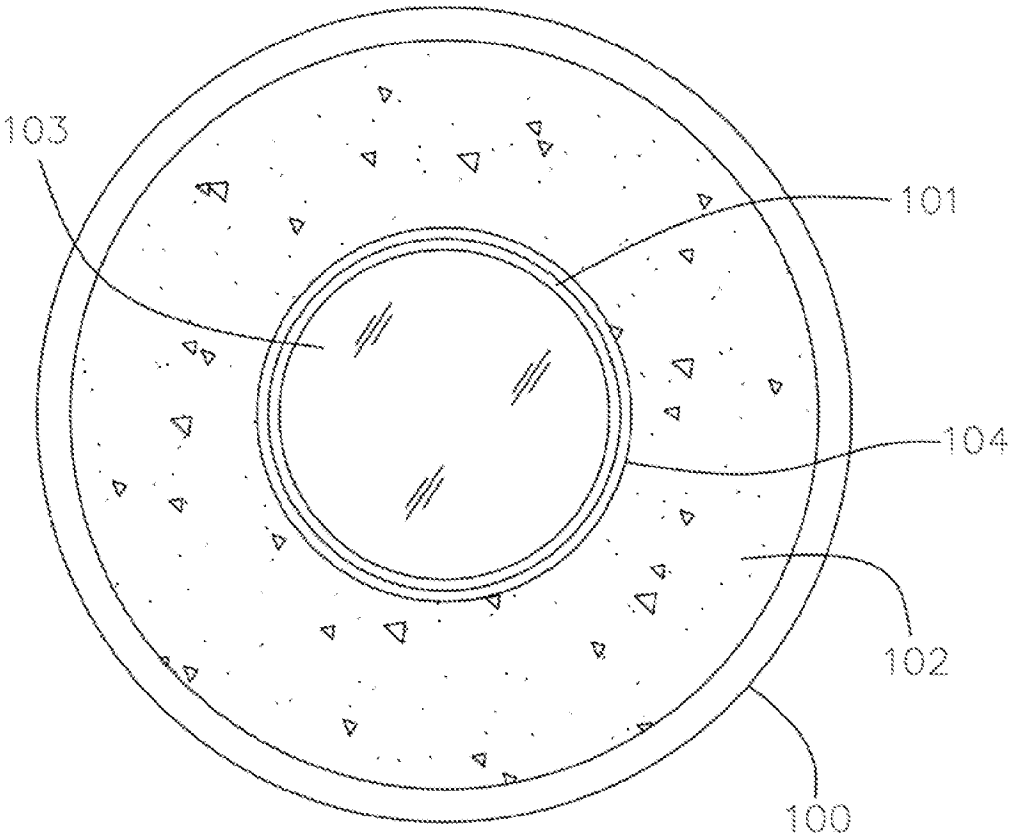
FIG. 3 shows a top and a base shield on a center dish.
Figure 4:
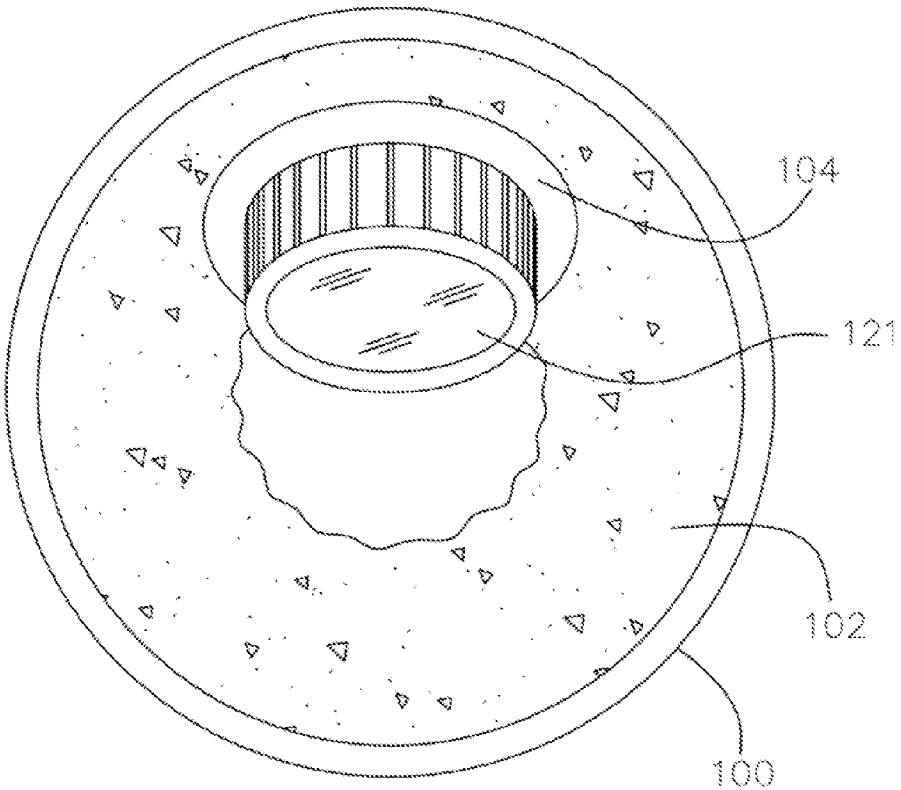
FIG. 4 shows a top and a base shield on a center dish.
Figure 5:
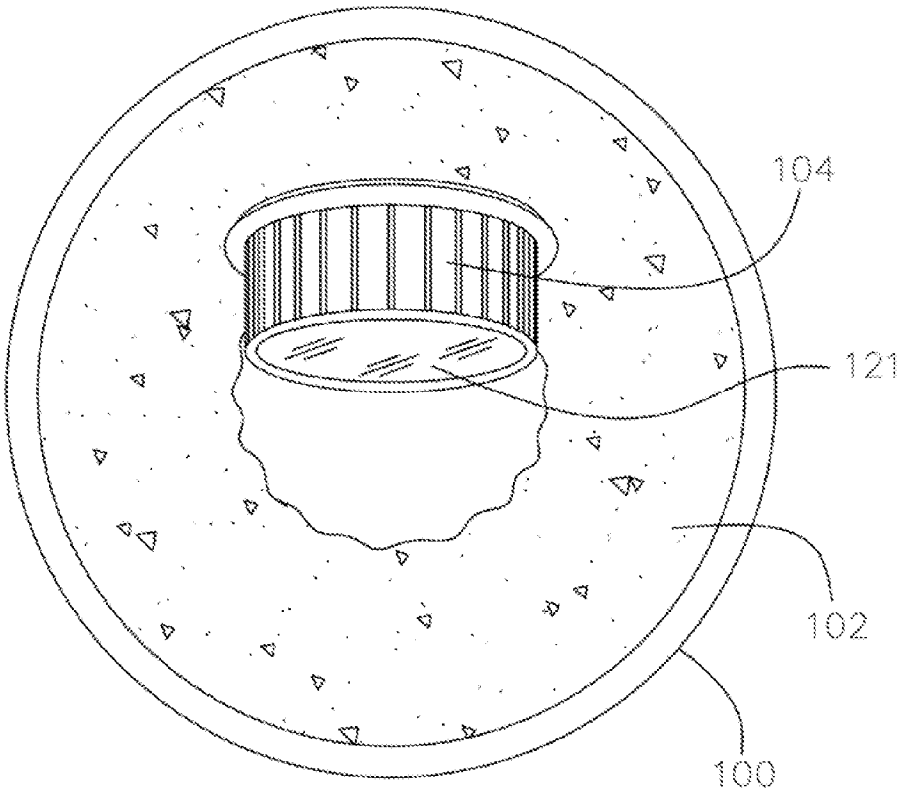
FIG. 5 shows a top and base shield on a center dish.

Referring to FIGS. 2-5, several aspects of a microwave container are shown. Referring now to FIG. 2, a microwave dish 100 is shown. The dish 100 comprises an outer concentric section 102 containing mashed potatoes and an inner dish 104 disposed in the center of the concentric section 102. The inner dish 104 comprises a polymeric film lidding 101 having a shielding material 103 affixed to the lidding 101. The food contained within the inner dish 104 is thus shielded from microwave energy both by the shielding material 103 and by the mashed potatoes disposed in the outer concentric section 102 surrounding the inner dish 104. Referring to FIG. 4, in certain embodiments, the base of the inner dish 104 may comprise a shielding material 121. It will be appreciated by one of skill in the art that many specific configurations may be designed to manipulate the microwave absorbing capacity of high heat capacity foodstuffs to assist in shielding another food having a faster cooking time, with the result of cooking different types of materials to the same temperature in a microwave oven.

Figure 1:
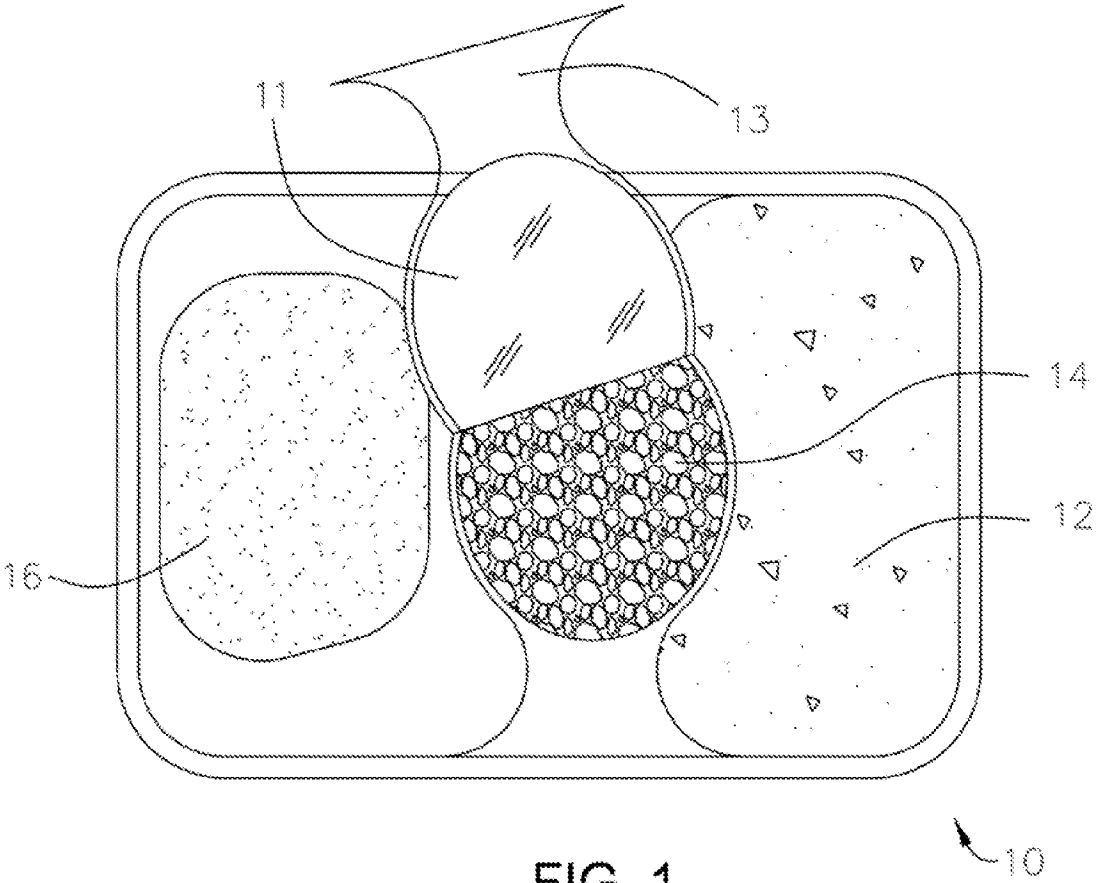
FIG. 1 shows a microwave food tray having its lidding pulled back, with a shield disposed over the center compartment.

Referring to FIG. 1, an alternate embodiment is shown comprising a multi-compartment microwave container 10. The container 10 comprises an oval central compartment 14 having applesauce disposed therein. The container 10 comprises a second compartment 12 adjacent to the oval compartment 14 and having mashed potatoes disposed therein. The container 10 further comprises a third compartment 16 also adjacent to the oval compartment 14, located on the opposite side of the container from the second compartment 12 and having meatloaf disposed therein. The second and third compartments 12 and 16 containing high heat capacity foods absorb a substantial amount of microwave energy, thereby acting as shields for the applesauce in the central compartment 14. Moreover, the container 10 comprises a metal foil shield 11 disposed on the lidding 13 configured to be located substantially in register with the central compartment 14, and optionally an additional shield disposed on the underside of the base of the central compartment 14 (not shown). These one or more shields will assist the high heat capacity foodstuff in achieving a low temperature within the central compartment 14 upon exposure to microwave energy.

EXAMPLES

The following examples are illustrative of embodiments of the present invention, as described above, and are not meant to limit the invention in any way. As discussed above, various configurations of microwave shields may be provided on a microwave container to provide even heating of food disposed within the container. Experiments were thus conducted to determine the effects of varied sizes and locations of shielding on the outside of the cooking container on temperature of different types of foodstuff.

Example 1

The experiments of Example 1 were performed on a microwave container comprising CPET as the microwave-transparent container material and aluminum foil as the shielding material. The microwave container tested comprised a two-compartment container having the general shape shown in FIGS. 6-8. More particularly, the container comprised a first shield comprising a base having a semi-circle shape with rounded edges, defined by a perimeter of the base. The base comprised a plurality of sidewalls extending upwardly from the perimeter of the base and having an upper edge comprising a lip extending radially from the upper edge of the sidewalls. The height of the sidewalls was one and one-quarter inches, which was approximately the same height as the sidewalls of the container compartment. The lidding comprised a second microwave shield disposed on and adhered to the center of the lidding, separated from the perimeter or upper edges of the sidewalls by one half of an inch. Applesauce was placed in the shielded compartment, the lidding was affixed to the top of the container, and the entire container was frozen. Next, each frozen shielded container was removed from the freezer and placed in a microwave oven.

Figure 11:
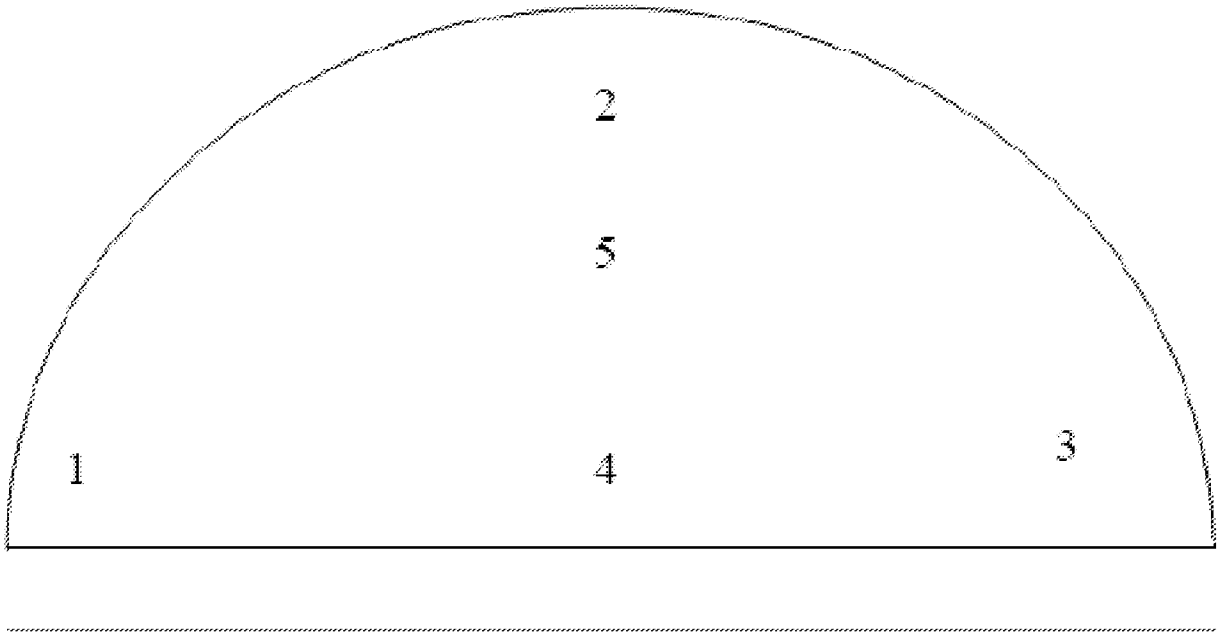
FIG. 11 shows a diagram of the locations at which temperatures were taken in a compartment following microwave cooking.

After three minutes and fifteen seconds of cooking in an 805 watt Panasonic microwave oven, the temperature of the applesauce was measured, at three depths at each of five locations within the dish. FIG. 11 shows an approximate diagram of the five locations at which the temperature of the applesauce was measured within the shielded compartment. Locations 1 and 3 represent the corners of the compartment, locations 2 and 4 represent the middle edges of the compartment, and location 5 represents the center of the compartment. The three depths measured at each location were the top/surface, the middle, and the bottom of the applesauce.

Figure 12:
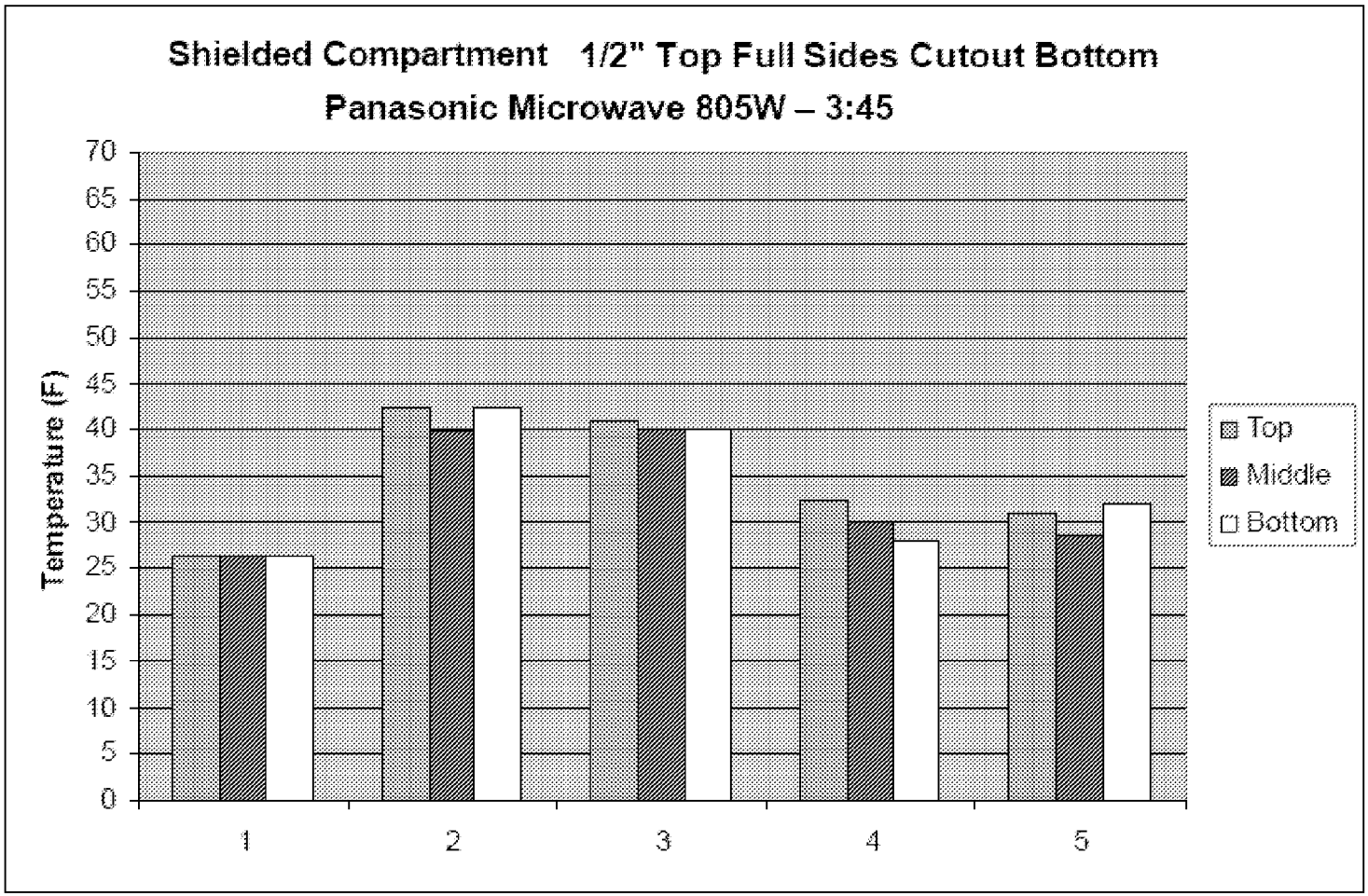
FIG. 12 shows a bar graph of temperatures of applesauce at different locations following microwave cooking in a shielded container.

FIG. 12 shows a bar graph with the experimental results following microwave cooking of the frozen applesauce. The experimental data demonstrates that the shielding is capable of maintaining a foodstuff at a relatively low temperature, of less than 45 degrees Fahrenheit, even after more than three minutes of microwave cooking. Further, the data shows that the shielding resulting in even heating, with a maximum temperature difference between the locations in the compartment of less than 20 degrees Fahrenheit. The greatest difference in temperature was from the material at the corner location 1 to the material at the middle edge location 2. The temperature variation in depths ranged from no difference between the top, middle and bottom depths of applesauce at the corner location 1 to four degrees difference between the top and bottom depths of applesauce at the middle edge location 4.

Comparative Example 2

The experiments of Comparative Example 2 were performed on a microwave container having the same configuration as Example 1, except that no microwave shields were provided on the container. Applesauce was placed in the shielded compartment, the lidding was affixed to the top of the container, and the entire container was frozen. Next, the frozen shielded container was removed from the freezer and placed in a microwave oven. After three minutes and fifteen seconds of cooking in an 805 watt Panasonic microwave oven, the temperatures of the applesauce was measured, at the three depths at each of the same five locations within the dish as Example 1.

Figure 13:
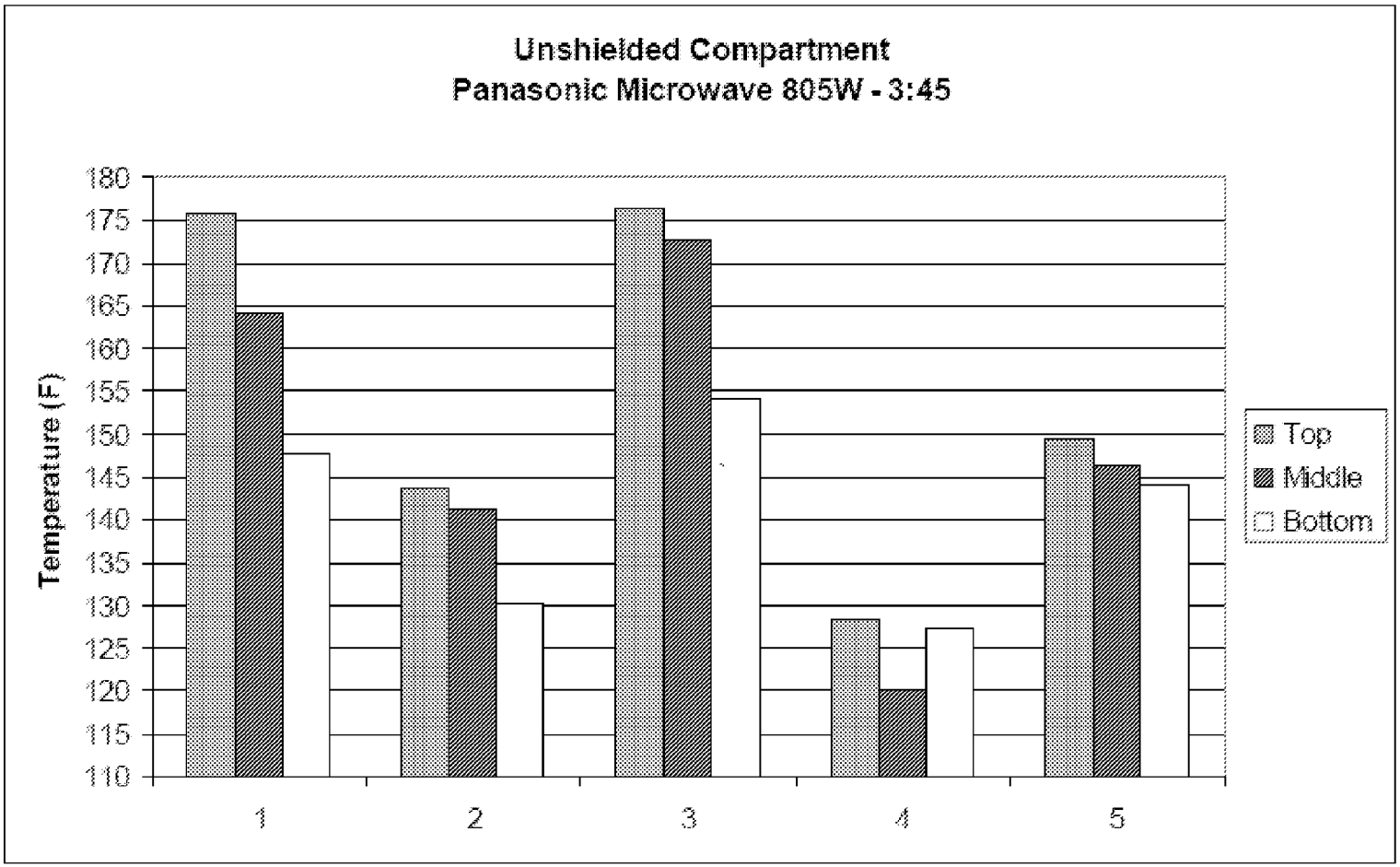
FIG. 13 shows a bar graph of temperatures of applesauce at different locations following microwave cooking in an unshielded container.

FIG. 13 shows a bar graph with the experimental results following microwave cooking of the frozen applesauce. The experimental data demonstrates that a lack of shielding results in a substantial variation between the temperature of the applesauce both by depth and by location after the microwave cooking Contrary to Example 1, the maximum temperature difference between the locations in the compartment is over 55 degrees Fahrenheit. The greatest difference in temperature by compartment location was from the material at the corner location 3 to the material at the middle edge location 4. The smallest difference in temperature variation by depth was about five degrees, from the top, middle and bottom depths of applesauce at the center location 5. The greatest difference in temperature variation by depth was about twenty-eight degrees, from the top, middle and bottom depths of applesauce at the corner location 1.

Consequently, the results of Example 1 and Comparative Example 2 demonstrated that the microwave shielding of Example 1 is capable of providing a significant improvement in the evenness of heating throughout a container cooked in a microwave oven.

Example 3

The experiments of Example 3 were performed on microwave containers comprising CPET as the microwave-transparent container material and comprising aluminum foil as the shielding material. Each microwave container tested comprised a first shield of varied size and location on the outside of a two-compartment container having the general shape shown in FIGS. 6-8 and described in Example 1. Further, each microwave container tested comprised a second shield of varied size affixed to the lidding. The aspects varied on the first shield were the height of the sidewalls and the radius of the aperture on the base of the shield. The aspect varied on the second shield was the distance provided between the outer perimeter of the second shield and the container sidewalls. The height of the sidewalls ranged from three quarters of an inch to one and one-quarter inches (i.e., full height). The radius of the aperture ranged from one quarter of an inch to three quarters of an inch. The gap between the second shield and the container sidewalls was either one half of an inch or zero distance (i.e., full shield).

For each shielded container, applesauce was placed in the shielded compartment, macaroni and cheese was placed in the unshielded compartment, a lidding was affixed to the top of the container, and the entire container was frozen. Next, each frozen shielded container was removed from the freezer and placed in a microwave oven. After three minutes and fifteen seconds of cooking in an 805 watt Panasonic microwave oven, the temperatures of the foodstuff were measured.

Figure 14:
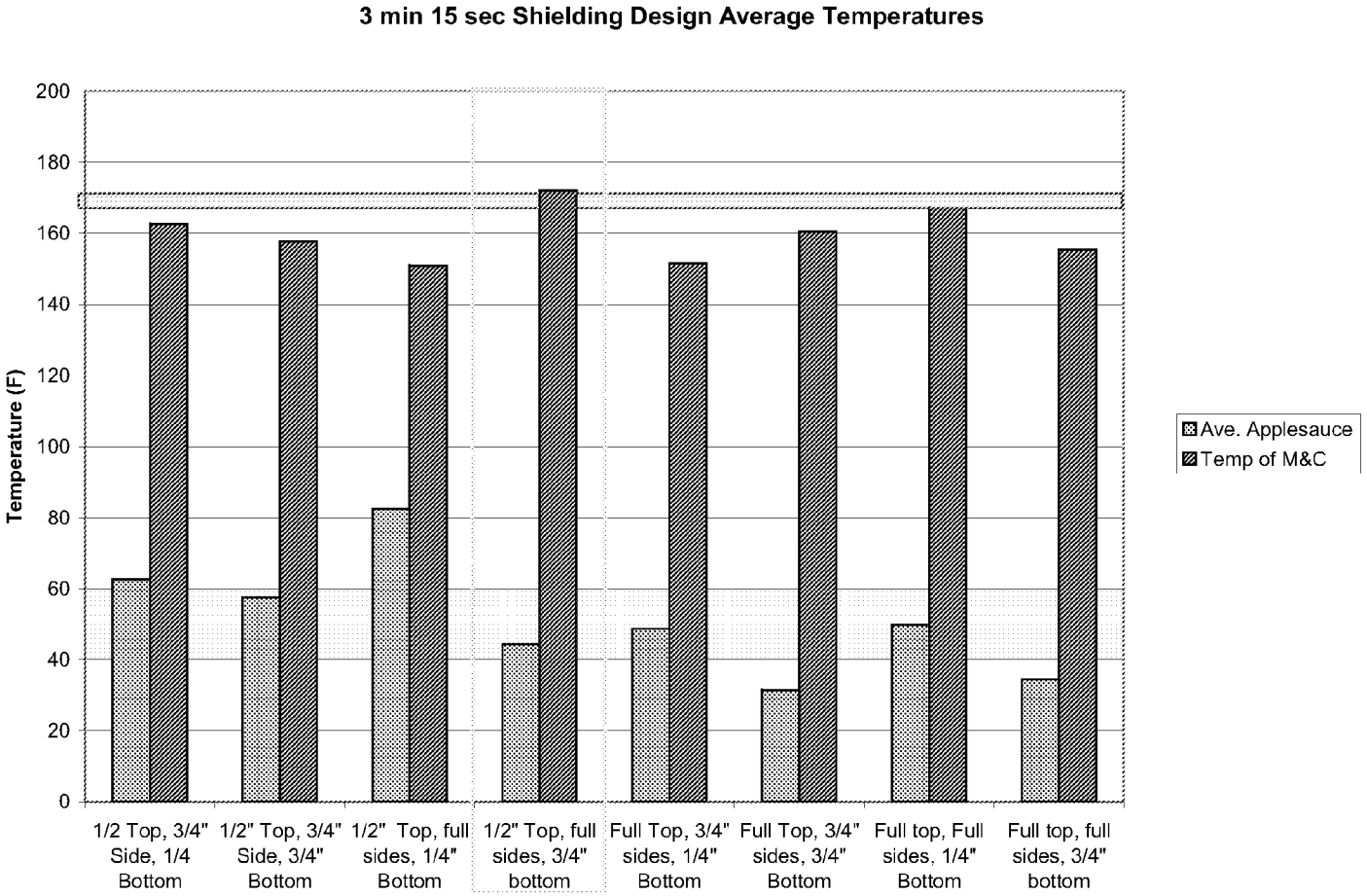
FIG. 14 is a bar graph of average temperatures of applesauce and macaroni and cheese following cooking for three minutes and fifteen seconds, in various shielded containers.

FIG. 14 shows a bar graph with the experimental results following microwave cooking of the frozen applesauce and macaroni and cheese. The microwave shields comprising the configuration of the full height of the sidewalls of the first shield of one and one-quarter inches and an aperture radius of three quarters of an inch, plus a distance between the second shield and the container sidewalls of one half of an inch provided the optimal heating characteristics, in which the temperature of the applesauce was the coolest in combination with a low risk of arcing or sparking during cooking due to the horizontal gap between the two shields.

Example 4

The experiments of Example 4 were performed according to the materials and procedures of Example 3, except that each frozen shielded container was cooked for three minutes and forty-five seconds in a different 805 watt Panasonic microwave oven.

Figure 15:
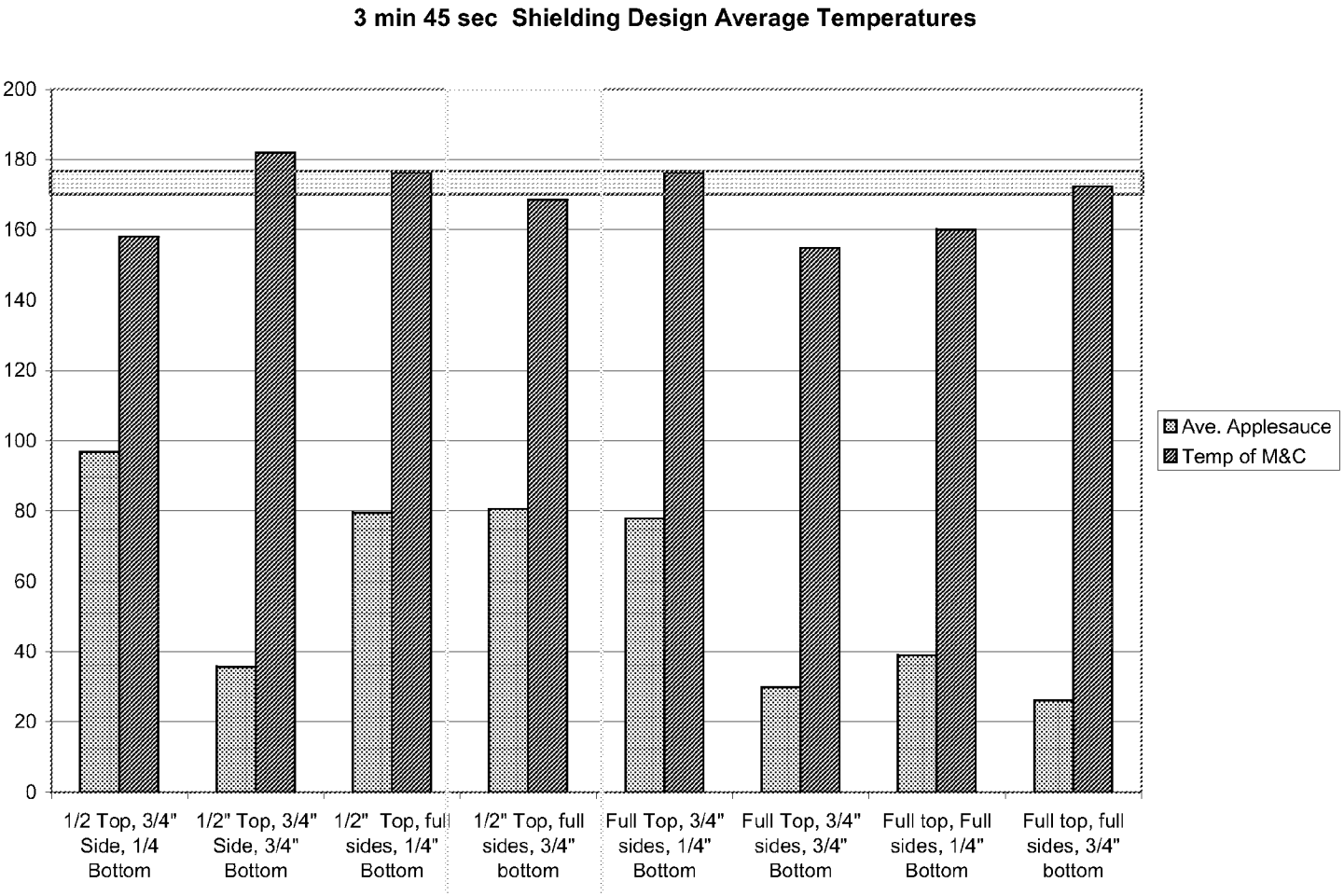
FIG. 15 is a bar graph of average temperatures of applesauce and macaroni and cheese following cooking for three minutes and forty-five seconds, in various shielded containers.

FIG. 15 shows a bar graph with the experimental results following microwave cooking of the frozen applesauce and macaroni and cheese. Surprisingly, the microwave shields comprising the configuration of the full height of the sidewalls of the first shield of one and one-quarter inches and an aperture radius of three quarters of an inch, plus a distance between the second shield and the container sidewalls of one half on an inch provided the same temperatures of applesauce and macaroni and cheese, despite an additional thirty seconds of heating. This configuration again provided optimal heating characteristics, in combination with a low risk of arcing or sparking during cooking due to the horizontal gap between the two shields.

Example 5

In the microwave container of Example 5, a multi-compartment container was configured to position high specific heat capacity foodstuff in two outer compartments on either side of a central compartment, as shown in FIG. 1. Applesauce was disposed in the central compartment, and mashed potatoes and meatloaf in the two outer compartments, respectively. A lidding was affixed to the top of the container, and the entire container was frozen. Next, the frozen shielded container was removed from the freezer and placed in a microwave oven. The central compartment comprised both top and bottom metal foil shielding, and the high specific heat capacity foods disposed in the outer compartments effectively shielded the sides of the central compartment, with little exposure to the effects of the microwave energy other than from the unshielded outer container sidewalls. Following three minutes of cooking the frozen container, the applesauce in the central compartment was determined to be approximately 50 degrees Fahrenheit, whereas the mashed potatoes and meatloaf in the outer compartments were fully cooked and hot, exhibiting a temperature of over 160 degrees Fahrenheit. Food alone was not capable of shielding the applesauce to the extent that the combination of high heat capacity food and metal foil shielding, however. Heating the same microwave container, except without the metal foil shields, for three minutes resulted in the same temperatures of over 160 degrees Fahrenheit for the meatloaf and mashed potatoes, and an applesauce temperature of approximately 170 degrees Fahrenheit. The presence of the metal foil shielding, therefore, resulted in a temperature difference for the applesauce of about 120 degrees Fahrenheit under otherwise identical cooking conditions.

Example 6

In the microwave container of Example 6, a multi-compartment container was configured to provide a high specific heat capacity foodstuff in a round dish, concentrically surrounding an inner round dish, as shown in FIGS. 2-5. Mashed potatoes were placed in both the inner dish and the outer dish, a lidding was affixed to the top of each of the two dishes, and the entire container was frozen. Next, the frozen shielded container was removed from the freezer and placed in a microwave oven. The inner dish comprised both top and bottom metal foil shielding. Due to the shields and the high specific heat capacity food material surrounding the inner dish, the inner dish was effectively shielded on all sides. Following five minutes of cooking, the temperature of inner dish was measured to be below 40 degrees Fahrenheit while the surrounding material was above 120 degrees Fahrenheit. The warming of the inner dish is believed to be mainly from heat transfer from the surrounding material to the inner dish. Accordingly, providing an inner dish comprising a material having a degree of insulating value would keep the inner dish even cooler during microwave cooking.

While the invention has been described with respect to specific examples including presently preferred modes of carrying out the invention, those skilled in the art will appreciate that there are numerous variations and permutations of the above described systems and techniques that fall within the spirit and scope of the invention. It should be understood that the invention is not limited in its application to the details of construction and arrangements of the components set forth herein. Variations and modifications of the foregoing are within the scope of the present invention. It is also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

We claim:

1. A container comprising:

at least one compartment comprising a base comprising a shape having a perimeter; and a plurality of sidewalls extending from the perimeter of the base at an angle therefrom, the at least one compartment comprising a first shield comprising a material opaque to microwave energy disposed on an inner or outer surface of the base and the plurality of sidewalls; and a lidding comprising a second shield comprising a material opaque to microwave energy disposed on the lidding, wherein upon sealing of the lidding on the at least one compartment, an edge of the second shield is at a distance of at least one eighth of an inch from the plurality of sidewalls.

2. The container of claim 1, wherein the distance from the plurality of sidewalls is at least one half of an inch.

3. The container of claim 1, wherein food is disposed in the at least one compartment or on the lidding.

4. The container of claim 1, wherein the first shield defines an aperture centered on the base, the aperture comprising the same shape as the base.

5. The container of claim 1, wherein the second shield is centered on the lidding.

6. The container of claim 1, wherein the container comprises a second compartment, wherein the second compartment consists essentially of one or more materials transparent to microwave energy.

7. The container of claim 1, wherein the lidding comprises a polymeric film.

8. The container of claim 1, wherein the first and second shields comprise metal foil.

9. The container of claim 1, wherein the first shield comprises a plurality of individual pieces of material opaque to microwave energy.

10. The container of claim 1, wherein the plurality of sidewalls comprise an upper edge comprising a lip extending radially from the upper edge of the sidewalls.

11. The container of claim 4, wherein the aperture of the first shield comprises at least one of a height or width of at least one half of an inch.

12. The container of claim 1, wherein the angle is at which the sidewalls extend upwardly from the container base is between about 60 degrees and about 135 degrees with respect to the base.

13. A container comprising:

at least one compartment comprising:

a material transparent to microwave energy;

a base comprising a shape having a perimeter; and at least one sidewall extending from the perimeter of the base at an angle therefrom and having an upper edge, the at least one compartment comprising a first shield comprising a material opaque to microwave energy disposed on an inner or outer surface of the base and the at least one sidewall; and a lidding comprising a second shield comprising a material opaque to microwave energy disposed on the lidding, wherein upon sealing of the lidding on the at least one compartment, an edge of the second shield is at a distance of at least one eighth of an inch from the at least one sidewall.

14. The container of claim 13, wherein food is disposed in the at least one compartment or on the lidding.

15. The container of claim 13, wherein the second shield is affixed to the lidding with an adhesive.

16. The container of claim 13, wherein the first and second shields comprise metal foil.

17. The container of claim 13, wherein the upper edge of the at least one sidewall comprises a lip extending radially from the upper edge.

18. The container of claim 17, wherein the first shield further comprises a lip disposed on an outer surface of the lip of the at least one sidewall.

19. A container comprising:

a first compartment comprising:

a material substantially transparent to microwave energy, the material formed to have a base and at least one sidewall; and a first shield comprising a material substantially opaque to microwave energy disposed only on an inner or an outer surface of the base of the first compartment;

a second compartment at least partially surrounding the first compartment; and a lidding to cover the first compartment, the lidding comprising a second shield comprising a material opaque to microwave energy disposed on the lidding.

20. The container of claim 19, wherein the second compartment completely surrounds the first compartment.

21. The container of claim 19, further comprising a third compartment at least partially surrounding the first compartment.

* * * * *

UNITED STATES PATENT AND TRADEMARK OFFICE

CERTIFICATE OF CORRECTION

PATENT NO. : 8,497,455 B2
APPLICATION NO. : 12/714131
DATED : July 30, 2013
INVENTOR(S) : Hodson et al.

It is certified that error appears in the above-identified patent and that said Letters Patent is hereby corrected as shown below:

On the Title page item [56],

On the page 2, column 2, line 22, delete "Surry," and insert -- Surrey, --, therefor.

On the page 2, column 2, line 24, delete "Surly," and insert -- Surrey, --, therefor.

Drawings

On sheet 14 of 14, in Figure 15, y-axis, line 1, delete "

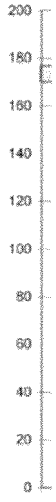

" and insert --

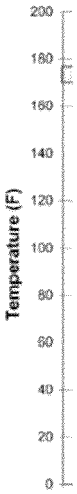

--, therefor.

In the Specification,

Column 3, line 16, delete "(CPET)" and insert -- (CPET), --, therefor,

Column 10, line 67, delete "cooking" and insert -- cooking. --, therefor.

Signed and Sealed this
Tenth Day of May, 2016

Michelle K. Lee

Michelle K. Lee
*Director of the United States Patent and Trademark Office*